United States Patent [19]

Marsh et al.

[11] Patent Number: 4,839,094

[45] Date of Patent: Jun. 13, 1989

[54] OVERBASED ALKALI METAL ADDITIVES

[75] Inventors: John F. Marsh, Abingdon; John A. Cleverley, Didcot, both of United Kingdom

[73] Assignee: Exxon Chemical Patents Inc., Linden, N.J.

[21] Appl. No.: 88,791

[22] Filed: Aug. 24, 1987

[30] Foreign Application Priority Data

Sep. 4, 1986 [GB] United Kingdom ..... 86-21343

[51] Int. Cl.[4] ..... C10M 135/30

[52] U.S. Cl. ..... 252/42.7; 252/33

[58] Field of Search ..... 252/42.7

[56] References Cited

U.S. PATENT DOCUMENTS

| | | | |
|---|---|---|---|
| 2,356,661 | 8/1944 | Downing et al. | 252/37 |
| 2,920,105 | 1/1960 | Kluge et al. | 260/504 |
| 3,346,493 | 10/1967 | LeSuer | 252/32.5 |
| 3,428,561 | 2/1969 | LeSuer | 252/32.5 |
| 3,428,564 | 2/1969 | Bluestein et al. | 252/33 |
| 3,437,465 | 4/1969 | LeDuer | 44/51 |
| 3,471,403 | 10/1969 | LeSuer et al. | 252/39 |
| 3,488,284 | 1/1970 | LeSuer | 252/33 |
| 3,489,682 | 1/1970 | LeSuer | 252/32.7 |
| 3,779,920 | 12/1973 | Devries | 252/42.7 |
| 3,810,837 | 5/1974 | Chafetz et al. | 252/42.7 |
| 3,969,235 | 7/1976 | Sung et al. | 252/42.7 |
| 4,100,085 | 7/1978 | Peditto et al. | 252/42.7 |
| 4,104,180 | 8/1978 | Burnop | 252/33 |
| 4,171,269 | 10/1979 | Sung et al. | 252/45 |
| 4,171,270 | 10/1979 | Sung et al. | 252/45 |
| 4,229,309 | 10/1980 | Cheng et al. | 252/24 |
| 4,320,016 | 3/1982 | Zoleski et al. | 252/42.7 |
| 4,326,972 | 4/1982 | Chemberlin | 252/33.3 |
| 4,514,313 | 4/1985 | LeCoent | 252/42.7 |

FOREIGN PATENT DOCUMENTS

| | | |
|---|---|---|
| 0024146 | 9/1985 | European Pat. Off. . |
| 0212922 | 4/1987 | European Pat. Off. . |
| 0235929 | 9/1987 | European Pat. Off. . |
| 1388021 | 3/1975 | United Kingdom . |
| 1551820 | 4/1976 | United Kingdom . |
| 1481553 | 8/1977 | United Kingdom . |
| 2055885 | 6/1983 | United Kingdom . |
| 2055886 | 7/1983 | United Kingdom . |

OTHER PUBLICATIONS

Research Disclosure No. 157, May 1977, p. 11, Disclosure No. 15729 of *Industrial Properties Ltd.*, "Anti—Rust Additives for Lubricating Oils".

*Primary Examiner*—William R. Dixon, Jr.
*Assistant Examiner*—Ellen McAvoy
*Attorney, Agent, or Firm*—J. B. Murray, Jr.

[57] ABSTRACT

A process for making an oil solution of a highly basic alkali metal compound which comprises (a) heating alkali metal hydroxide with an alkoxyalkanol and a solvent to remove water as an azeotrope with alkoxyalkanol and said solvent;
(b) adding to the mixture surfactant;
(c) thereafter introducing carbon dioxide into the reaction mixture so as to react with the basic compounds therein;
(d) hydrolysing the reaction mixture; and
(e) removing solvent by distillation, base oil being added to the process during one of steps (b), (c), (d) and (e) so that the desired product is obtained.

8 Claims, No Drawings

OVERBASED ALKALI METAL ADDITIVES

This invention relates to processes for preparing overbased additives.

Lubricants often need the presence of detergents and there is an increasing need for detergent additives which have high basicity, especially automotive lubricants where their high basicity neutralises acids formed during operation of the engine. This invention relates to such a high basicity or "overbased" additives which contain colloidally dispersed carbonates and their preparation. In particular it relates to the preparation of overbased potassium sulphonates and overbased alkali metal phenates.

Various patents disclose processes for making overbased additives and include passing references to preparation of such additives containing alkali metals but we have found that many of these processes are not effective at producing commercially useful products. Prior art processes tend to form products which are hazy due to instability of the colloid. Examples of prior art processes include U.S. Pat. Nos. 3428561, 3437465, 3471403, 3488284, 3489682 and 4326972.

As the equivalent weight of the overbasing metal cation increases the total mass and volume of the colloidal metal carbonate suspension, at an equivalent base number, also increases. This effect makes it more difficult to prepare colloidally stable additives from the higher equivalent weight metals. Accordingly, of the alkali metals, it is most difficult to prepare colloidally stable additives of potassium.

The ease of metal carbonate overbasing is also affected by the type/structure of the surfactant used to stabilise the colloidal suspension. With the alkali metal detergents it is more difficult to stabilise overbased alkali metal sulphurised phenates than the corresponding sulphonates. Thus a class of additives that are particularly difficult to prepare are overbased potassium sulphonate and overbased alkali metal sulphurized phenates.

We have found that this class of additives may be prepared by a route involving the initial formation of a alkoxyalkoxide, carbonation under substantially anhydrous conditions and hydrolysis following carbonation.

In accordance with this invention, an oil solution of an overbased alkali metal sulphonate or sulphurized phenate is prepared by a process which comprises:

(a) heating an alkali metal hydroxide with an alkoxyalkanol and a solvent to remove water as an azeotrope with said alkyoxyalkanol and solvent so as to form a mixture comprising substantially anhydrous alkali metal alkoxide;

(b) adding to the mixture a surfactant comprising an organic sulphonic acid and/or a sulphurized phenol, with the proviso that when the surfactant is an organic sulphonic acid the alkali metal is potassium, and continuing azeotroping to remove substantially all water formed;

(c) thereafter introducing carbon dioxide into the reaction mixture so as to react with the basic compounds therein to form a carbonated alkali metal alkoxyalkoxide;

(d) hydrolysing the carbonated alkali metal alkoxyalkoxide; and (e) removing solvent by distillation, base oil being added to the process during one of the steps (b), (c), (d) and (e) so that the desired product is obtained.

This process enables one to obtain highly basic alkali metal additives having relatively high total base numbers (TBN) of at least 250 mg KOH/g. TBN is a measure of basicity of a product and is measured by the method laid down in ASTM D2896.

The alkali metal hydroxide starting materials may be for example sodium hydroxide, potassium hydroxide or lithium hydroxide, and the normal commercial grades may be used. Hydrates, such as lithium monohydrate, may be used since the azeotroping of step (a) enables such water of hydration to be removed. While the procedure of the invention may be used to form lithium and sodium sulphonates we have found that these products are more economically made by different routes.

The solvent can be, for example, any aliphatic, naphthenic or aromatic solvent provided it forms an azeotrope with water; in particular, n-hexane, n-heptane, n-octane, n-dodecane, benzene, xylene, toluene, white spirit, naphtha or isoparaffins. Usually, it is a hydrocarbon solvent but it could be a halogenated hydrocarbon, e.g. chlorobenzene. The most preferred solvents are toluene and xylene.

Although aromatic substituted alkoxyalkanols, could be used, it is preferable to use an aliphatic alkoxyalkanol, especially those containing 2 to 10 carbon atoms per molecule. Suitable examples of aliphatic alkoxyalkanols are methoxy methanol, methoxy ethanol, methoxy isopropanol, ethoxy methanol, 2-ethoxy ethanol, 2-butoxy-ethanol or propylene glycol ethers, e.g. methoxy propanols, butoxy propanols or phenoxy propanols.

The amount of alkoxyalkanol employed in the process per mole of sodium hydroxide will usually be in the range of 0.5 to 50, preferably 0.75 to 2.

The surfactant employed may be an organic sulphonic acid, a sulphurized phenol or a mixture of both, optionally with additional surfactants.

The organic sulphonic acids are usually obtained from the sulphonation of natural hydrocarbons or synthetic hydrocarbons; e.g. a mahogany or petroleum alkyl sulphonic acid; an alkyl sulphonic acid or an alkaryl sulphonic acid. Such sulphonic acids are obtained by treating lubricating oil basestocks with concentrated or fuming sulphuric acid to produce oil-soluble "mahogany" acids or by sulphonating alkylated aromatic hydrocarbons. Sulphonates derived from synthetic hydrocarbons include those prepared by the alkylation of aromatic hydrocarbons with olefins or olefin polymers; e.g. $C_{15}$–$C_{30}$ polypropenes or polybutenes. Also suitable are the sulphonic acids of alkyl benzenes, alkyl toluenes or alkyl xylenes, which may have one or more alkyl groups wherein each group, which may be straight or branched preferably contains at least 12 carbon atoms. The preferred sulphonic acids have molecular weights of from 300 to 1000, for example, between 400 and 800, e.g. about 500. Mixture of these sulphonic acids may also be used.

The sulphurized phenol may be, for example, a compound of the general formula:

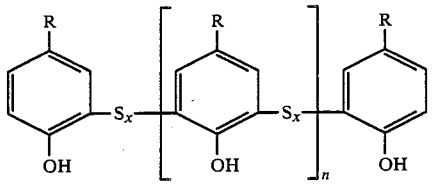

where x = 1 or 2, n = 0, 1 or 2 and each R is an alkyl radical and the average number of carbon atoms in all of the R groups is preferably at least about 9 in order to ensure adequate solubility in oil. The individual R groups may each contain from 5 to 40, preferably 8 to 20, carbon atoms. Such phenols and their preparation are well-known to those skilled in the art.

The mole ratio of the primary surfactant to alkali metal hydroxide is usually between 1:5 and 1:36, preferably 1:10 to 1:25.

Although a sulphonic acid and/or sulphurized phenol may be sufficient to act as the surfactant for the overbased material of the invention, especially when it has a relatively high molecular weight aliphatic chain e.g. of molecular weight more than about 400, very often it is desirable to include another surfactant having a long aliphatic chain usually with a molecular weight of 700 or greater, for example about 900, in the reaction mixture.

This additional surfactant may be, for example, a dicarboxylic acid or anhydride, or an ester, amide, imide, amine salt or ammonium salt of a dicarboxylic acid and as such include those represented by the formulae:

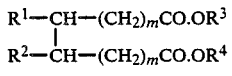

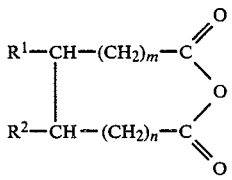

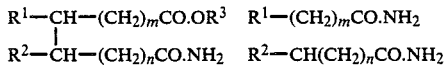

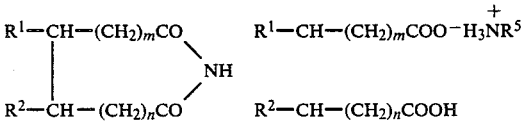

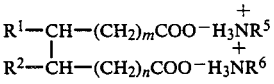

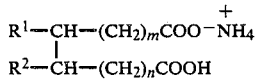

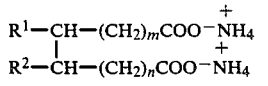

where $R^1$ and $R^2$ are hydrogen or optionally-substituted hydrocarbyl groups of at least 30 carbon atoms provided they are not both hydrogen, m and n are zero or integers, $R^3$ and $R^4$ and hydrogen or hydrocarbyl groups and $R^5$ and $R^6$ are hydrocarbyl groups.

It is preferred that $R^2$ be hydrogen and that m and n be zero or a small integer, e.g. 1 or 2. In general, acids or anhydrides are the preferred surfactant. However, if an ester, monoamide or ammonium salt is used, it is preferred that $R^3$, $R^4$, $R^5$ and $R^6$ are alkyl groups, especially a $C_1$ to $C_5$ alkyl group, for example, methyl, ethyl or propyl. If desired, however, the ester could be derived from a glycol, in which case $R^3$ and $R^4$ would not be separate hydrocarbyl groups, but instead, the residue of a glycol, for example, ethylene glycol or propylene glycol.

The most preferred compounds are those where $R^1$ contains 40 to 200 carbon atoms and where $R^1$ has no atoms other than carbon, hydrogen and halogen, and especially when it only contains carbon and hydrogen atoms, i.e., it is a hydrocarbyl group. Preferred hydrocarbyl groups are aliphatic groups.

The acid, anhydride, ester, amide, imide, amine salt or ammonium salt is preferably substantially saturated, but the substituent group, for example, the group $R^1$may be unsaturated. In practice, it is preferred that the substituent group be a polymer of a monolefin, for example, a $C_2$ to $C_5$ monolefin, such as polyethylene, polypropylene or polyisobutene. Such polymers will usually have only one double bond so that they could be regarded as predominantly saturated, especially since they must have at least 30 carbon atoms.

The most preferred acid or anhydride is one of the formula:

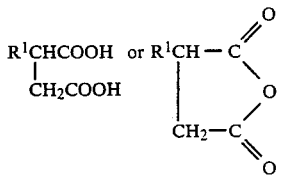

especially where $R^1$ is polyisobutenyl, i.e. a polyisobutenyl succinic acid or anhydride, preferably where $R^1$ has 30 to 200 carbon atoms, especially 45 to 60 carbon atoms. Such anhydrides are frequently known as PIBSA.

When such an acid, anhydride or ester is used, the molar ratio of primary surfactant to the acid, amide, imide, amine salt, ammonium salt, anhydride or ester can vary but is usually between 20:1 and 2:1, e.g. between 15:1 and 4:1.

The first step of the process is the reaction of alkali metal hydrixide with alkoxyalkanol in the mixture with solvent to form alkali metal alkoxyalkoxide. The reaction mixture is heated so that the temperature is slowly increased and any water of hydration, any contaminant water and the water formed by the reaction to form the alkoxyalkoxide is removed as an azeotrope with the solvent and the alkoxyalkanol. Little solvent is normally removed in the azeotrope, and the reaction vessel may be equipped with a condenser so that substantially all solvent is returned to the reaction vessel. The recovered azeotrope then comprises water and alkoxyalkanol with substantially no solvent. This heating which in effect is azeotropic distillation effectively controls the amount of hydroxide converted to alkoxyalkoxide since the removal of water drives the alkoxyalkoxide-forming reaction. The extent to which this reaction is driven and formed water is removed is critical since surprisingly it has been found that excess water in the system tends to result in a hazy and unsatisfactory product. It has further been discovered that a surprising and effective means of preventing this haze formation is by using the azeotroping to remove water from the system. By driving the reaction forming alkoxyalkoxide to completion and removing substantially all water from the system, effective control over haze may be obtained. Usually the azeotropic distillation takes at least one hour, and times of from 1.5 to 2 hours are typical for small scale operations.

In the next step the surfactant(s) are added, preferably at 50° C. to 70°0 C., and the azeotroping of the reaction mixture is continued. Surfactants are usually introduced as solutions in diluent oil, e.g. an aliphatic or aromatic hydrocarbon. The purpose of the azeotroping is to remove any further water in the system and particularly in the surfactant(s).

The alkali metal hydroxide reacts with the alkoxyalkanol according to the equation $$MOH + ROH \rightarrow MOR + H_2O$$

(where M is an alkali metal and R is an alkoxyalkyl group). When surfactant is added, this reacts with the alkali metal alkoxyalkoxide. In the case of a sulphonic acid this may be represented:

$$R''SO_2OH + MOR \rightarrow R''SO_2OM + ROH$$

(where R'' is the organic group of the sulphonic acid). In the case of a sulphurized phenol this may be represented for a simple case:

$$HO—Ar—S—Ar—OH + 2MOR \rightarrow MO—Ar—S—Ar—OM + 2ROH \text{ ps}$$

(where Ar is an alkylphenol nucleus). If an optional additional surfactant is present this will also react with alkali metal alkoxyalkoxide.

After anhydrous conditions have been reached and azeotroping ended, carbon dioxide is introduced to react with the basic sodium compounds in the reaction mixture which is preferably maintained at a temperature from ambient to the reflux temperature of the mixture, but more preferably below about 90° C. so that the reaction mixture is first cooled. The amount of carbon dioxide which is blown into or injected into the reaction mixture should be 90% to 115%, typically about 105%, of the theoretical amount required to react with available basic compounds.

In practice, carbon dioxide is blown in until no more carbon dioxide is absorbed, e.g. when the gas inlet and exit rates, as measured on gas flow meters are the same. Rates are usually chosen to introduce the carbon dioxide over 2 to 4 hours, e.g. about 3 hours.

The basic compound which will react with the carbon dioxide include any unreacted alkali metal hydroxide (although this is minimised in the process of the invention) which will react:

$$2MOH + CO_2 \rightarrow M_2CO_3 + H_2O$$

to form the desired overbased product. In addition alkali metal alkoxyalkoxide formed in step (a) will be carbonated to form additional carbonate in the product according to the reaction:

$$ROM + CO_2 \rightarrow RO—COOM$$

In step (d) the carbonated alkoxyalkoxide is subsequently hydrolysed:

$$2RO—COOM + H_2O \rightarrow 2ROH + CO_2 + M_2CO_3$$

This may be done by addition of just water, but preferably a mixture of water and alkoxyalkanol is added, to convert the residual carbonated alkoxyalkoxide to carbonate. Any mixture of water and alkoxyalkanol can be used preferably in a ratio of between 1:6 and 1:2 water:alkoxyalkanol (by weight). The water/alkoxyalkanol mixture is usually slowly added to the reaction mixture to convert the residual carbonated alkoxyalkoxide to alkali metal carbonate, alkoxyalkanol and carbon dioxide and this addition continues until the evolution of carbon dioxide ceases.

The next step in the process is to remove the recovered alkoxyalkanol and solvent by distillation. Usually, this takes place by atmospheric distillation typically at a temperature of about 180° C., optionally followed by distillation under reduced pressure whence the residual solvent and alkoxyalkanol will be removed. A nitrogen purge may be used to enhance this stripping.

Following this distillation step, solid contaminants may be removed from the product preferably by filtration or centrifuging. The desired product is the filtrate or centrifugate.

The desired product is a solution in oil and therefore base oil is added to the process in step (b), (c), (d) or (e). Most preferably the oil is added with the sulphonic acid in step (b). Base oils used in the process are preferably lubricating oils as described hereinafter.

The process of the invention enables a high quality, high TBN product to be obtained in good yields with reduced amounts of material losses in sludge and/or sediment and reduced problems in waste disposal which can arise when large amounts of sludge or flocculent material are produced. The process of the invention in particular provides a means of preparing a preferred product with a TBN of at least 250, preferably 250 to 600 mg (KOH)/g, more preferably 350 to 500, specifically in the region of 400 mg (KOH)/g.

The overbased additive of this invention is suitable for use in fuels or lubricating oils, both mineral and synthetic. The lubricating oil may be an animal, vegetable or mineral oil, for example, petroleum oil fractions ranging from naphthas or spindle ol to SAE 30, 40 or 50 lubricating oil grades, castor oil, fish oils or oxidised mineral oil.

Suitable synthetic ester lubricating oils include diesters such as dioctyl adipate, dioctyl sebacate, didecyl azelate, tridecyl adipate, didecyl succinate, didecyl glutarate and mixtures thereof. Alternatively the synthetic ester can be a polyester such as that prepared by reacting polyhydric alcohols such as trimethylolopropane and pentaerythritol with monocarboxylic acids sich as butyric acid, caproic acid, caprylic acid and pelargonic acid to give the corresponding tri- and tetraester.

Also, complex esters may be used as base oils such as those formed by esterification reactions between a dicarboxylic acid, a glycol and an alcohol and/or a monocarboxylic acid.

Blends of diesters with minor proportions of one or more thickening agents may also be used as lubricants. Thus one may use blends containing up to 50% by volume of one or more water-insoluble polyoxyalkylene glycols, for example, polyethylene or polypropylene glycol, or mixed oxyethylene/oxypropylene glycol.

The amount of overbased additive added to the lubricating oil should be a minor proportion, e.g. between 0.01% and 10% by weight, preferably between 0.1% and 5% by weight.

The final lubricating oil may contain other additives according to the particular use for the oil. For example, viscosity index improvers such as ethylene-propylene copolymers may be present as may ashless dispersants such as substituted succinic acid based dispersants, other metal containing dispersant additives, well known zinc dialkyldithio-phosphate antiwear additives, antioxidants such as oil-soluble copper compounds, demulsifiers, corrosion inhibitors, extreme pressure additives and friction modifiers.

The invention also includes an additive concentrate comprising an oil solution of a overbased compounds of the invention comprising 10 to 90 wt %, preferably 40 to 60 wt % overbased alkali metal salt (active matter) based on the weight of oil.

When used in fuels as a detergent or combustion improver the overbased material is used in minor proportions, e.g. between 0.01 and 10% by weight of the fuel.

The invention is now described with reference to the following examples:

EXAMPLE 1

Preparation of 400 TBN Sodium Sulphurised Phenate

To a five liter reactor fitted with stirrer, thermocouple, nitrogen purge, Dean and Stark receiver and condenser were added sodium hydroxide 560 g, xylene 1200 g and 2-ethoxyethanol 1450 g. This mixture was azeotroped until no further water was removed. 305 ml of azeotrope was recovered which was a mixture of water (and 2-ethoxyethanol). To this mixture was added an oil solution containing 72% of a sulphurised nonyl phenol 452.9 g, a polyisobutenyl succinic anhydride (PIBSA) with a molecular weight of 1000 80.5 g and oil (Stanco 150) 450 g. Azeotropic conditions were reapplied and these were continued until no further water as removed. A further 65 mls of azeotrope was recovered. The temperature of the mixture was then lowered to 90° C. and carbon dioxide injected into it at 600 $cm^3$/min until no further carbon dioxide was absorbed as seen by an exit flow meter. The carbonated complex was then hydrolysed with a mixture of 126 g water in 504 g 2-ethoxyethanol and a large volume of carbon dioxide was released. The mixture was then distilled to 180° C. followed by a vacuum strip to 180° C. (63.5 cm Hg) to remove the recovered 2-ethoxyethanol and xylene. The product was then filtered through a bed of Dicalite 4200 filter aid in a pressure filter to give a clear dark brown solution with the following properties.

| | |
|---|---|
| Total Base Number | 404 mg KOH/g |
| KV 100° C. | 37.7 cSt |
| Sodium Content A/A | 16.6 mass % |
| Haze 5% in SIS 3453 | 42 nephelos |

Comparative Example A

The preparation of Example 1 was repeated except that only 150 $cm^3$ of azeotrope was recovered in step 1. The finished product was hazy and blocked the filter.

EXAMPLE 2

Preparation of 400 TBN Overbased Lithium Sulphurised Phenate

To a 5 liter reactor fitted with stirrer, thermocouple, nitrogen purge, Dean and Stark receiver and condenser were added lithium hydroxide mono hydrate 588 g, 2-ethoxyethanol 1450 g and toluene 1200 g. This mixture was azeotroped until no distillate was recovered. A total of 585 $cm^3$ of a water 2-ethoxyethanol mixture was collected. To this mixture was added the solution of sulphurised nonyl phenol used in Example 1 760 g, nonyl phenol 188 g, the PIBSA of Example 1 112 92.5 g and Stanco 150 200 g. The azeotroping conditions were continued until no further distillate was recovered. A further 15 $cm^3$ of a water/2-ethoxyethanol mixture was collected. The temperature was then lowered to 90° C. and the mixture carbonated at 600 $cm^3$ until no further carbon dioxide was absorbed. The mixture was then hydrolysed with a mixture of 126 g water in 504 g 2-ethoxyethanol. On completion of the hydrolysis step the product was stripped and filtered as in Example 1.

The finished product filtered rapidly was clear and bright and had a TBN of 431 mg KOH/g.

Comparative Example B

The preparation of Example 2 was repeated with only 353 $cm^3$ of distillate removed during the initial azeotroping process. The product blocked the filter.

EXAMPLE 3

Preparation of High Base Number Potassium Sulphonate

To a five liter reactor fitted with stirrer, thermocouple, nitrogen purge, Dean and Stark receiver and condenser were added potassium hydroxide 448 g, 2-ethoxyethanol 1048 g and toluene 800 g. This mixture was azeotroped at a temperature of about 150° C. until no more water/ethoxyethanol distillate was recovered, 152 $cm^3$ of this distillate was removed. To this solution was added a mixture of a 70% oil solution of mixed alkyl benzene sulphonic acid (the major component being $C_{24}$ branched alkyl benzene sulphonic acid) 369.6 g, the PIBSA of Example 1 67.2 g, Stanco 150 291 g and nonyl phenol 113.2 g. The azeotroping conditions were continued and a further 26 $cm^3$ of distillate recovered. The temperature was then lowered to 90° C. and the mixture carbonated at 330 $cm^3$/minute for 7.5 hours when total breakthrough of the carbon dioxide occurred. The mixture was then hydrolysed with 61.2 grams of water in 183.6 g 2-ethoxyethanol. Towards the end of the water addition the viscosity of the product increased and it became necessary to add 250 $cm^3$ of 2-ethoxyethanol and 400 $cm^3$ of toluene. On completion of the hydrolysis step the product was distilled to 180° C. and vacuum stripped to 180° C. 25 in Hg. The product was then filtered rapidly through a bed of Special Speedflow filter aid in a pressure filter to give a dark brown additive with the following characteristics.

TBN 259 mg KOH/g, KV 100° C. 104.9 cS, flash point COC 172° C. and potassium content of 18.5%

Comparative Example C

Potassium hydroxide (120.3 g) was dissolved in methanol (300 $cm^3$), this was then added to a mixture of an oil solution of 90% of a $C_{24}$ branched chain sulphonic acid (98.1 g), Stanco 150 (156.4 g) and toluene (180

$cm^3$). The reactants were heated to reflux (70° C.) and carbon dioxide pumped in at 100 $cm^3$/min. After one hour's carbonation, the reaction mixture precipitated. On completion of the carbonation (4 hours) a large amount of solid was present.

Comparative Example D

An oil solution of 90% of a $C_{24}$ branched chain sulphonic acid (70 g), PIBSA (28.1 g), potassium hydroxide (120.3 g), 2 ethoxy ethanol (300 $cm^3$), Stanco 150 (156.4 g) and toluene (150 cm) were azeotroped until 42 $cm^3$of water was removed. $CO_2$ was then pumped in at 100 $cm^3$/min for 4 hours while continuing the azeotrope. A further 10 $cm^3$ of water/2-ethoxy ethanol mixture was removed. On completion of the carbonation the contents were vacuum stripped to 160° C./house vaccum and filtered. Although the filtration was satisfactory the product skinned and gelled on cooling making it unacceptable.

We claim:

1. A process for making an oil solution of an overbased alkali metal sulphurized phenate, which comprises (a) heating an alkali metal hydroxide with an alkoxyalkanol and a solvent to remove water as an azeotrope with said alkoxyalkanol and said solvent so as to form a mixture comprising substantially anhydrous alkali metal alkoxyalkoxide;

(b) adding to the mixture a surfactant comprising a sulphurized phenol and continuing the azeotroping to remove substantially all of the water formed;

(c) thereafter introducing carbon dioxide into the reaction mixture so as to form a carbonated alkali metal alkoxyalkoxide;

(d) hydrolysing the carbonated alkali metal alkoxyalkoxide; and (e) removing solvent by distillation, base oil being added to the process during one of steps (b), (c), (d) or (e) so that the desired product is obtained.

2. A process according to claim 1, wherein in step (b) there is also added a dicarboxylic acid or anhydride, ester, amide, imide, amine salt or ammonium salt thereof.

3. A process according to claim 2 wherein the acid or anhydride added in step (b) is a polyisobutenyl succinic acid or anhydride.

4. A process according to claim 1, wherein the solvent is toluene or xylene.

5. A process according to claim 1, wherein the alkoxyalkanol contains 2 to 10 carbon atoms per molecule.

6. A process according to claim 1, in which the sulphurized phenol is a compound of the general formula:

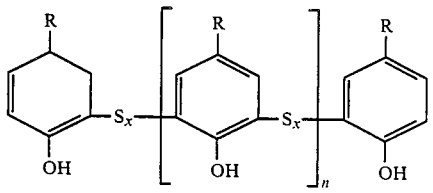

(wherein x=1 or 2, n=0, 1 or 2 and each R is an alkyl radical).

7. A process as claimed in claim 1, in which the carbonation is carried out at a temperature of less than 90° C.

8. A process as claimed in claim 1, in which the hydrolysis in step (d) is effected with a mixture of water and alkoxyalkanol.

* * * * *